US008158313B2

(12) United States Patent
Tsukamoto et al.

(10) Patent No.: US 8,158,313 B2
(45) Date of Patent: Apr. 17, 2012

(54) IMAGE FORMING APPARATUS FOR FORMING A COLOR IMAGE, AND IMAGE FORMING METHOD FOR FORMING A COLOR IMAGE

(75) Inventors: Takeo Tsukamoto, Yokohama (JP); Katsuo Sakai, Yokohama (JP); Tomoko Takahashi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 1222 days.

(21) Appl. No.: 11/481,914

(22) Filed: Jul. 7, 2006

(65) Prior Publication Data

US 2007/0015071 A1 Jan. 18, 2007

(30) Foreign Application Priority Data

Jul. 12, 2005 (JP) ..... 2005-203537

(51) Int. Cl.
*G03G 15/01* (2006.01)

(52) U.S. Cl. ..... 430/45.1; 430/42.1; 430/45.31; 430/45.51

(58) Field of Classification Search ..... 430/42.1, 430/45.1, 45.31, 45.51; 481/42.1, 45.1, 45.31, 481/45.51

See application file for complete search history.

(56) References Cited

U.S. PATENT DOCUMENTS 5,338,631 A * 8/1994 Masubuchi ..... 430/42.1
5,807,652 A * 9/1998 Kovacs ..... 430/45.31
5,955,228 A 9/1999 Sakai et al.
6,273,785 B1 * 8/2001 Mulroy et al. ..... 451/28
6,597,884 B2 7/2003 Miyaguchi et al.
6,708,014 B2 3/2004 Miyaguchi et al.
6,721,534 B2 4/2004 Takahashi (Continued)

FOREIGN PATENT DOCUMENTS

JP 54-82242 6/1979

(Continued)

OTHER PUBLICATIONS

U.S. Appl. No. 12/261,302, filed Oct. 30, 2008, Kosugi, et al.

(Continued)

*Primary Examiner* — Christopher Rodee
*Assistant Examiner* — Rachel Zhang
(74) *Attorney, Agent, or Firm* — Oblon, Spivak, McClelland, Maier & Neustadt, L.L.P.

(57) ABSTRACT

An image forming apparatus configured (a) to charge uniformly an image bearing member once, (b) to form a latent image including n levels of electric potential on the image bearing member with a single exposure, (c) to adhere a first toner on a portion of the image bearing member which has the lowest electric potential, (d) to decrease the electric potential of a portion of the image bearing member not developed with the first toner by uniformly exposing light at a first wavelength whose transmission factor is lowest for the first toner, (e) to develop using a second toner a portion of the image bearing member which has the second lowest electric potential, (f) to perform a second uniform exposure at a wavelength whose transmission factor is lowest for both the first toner and the second toner, (g) to develop using a third toner a portion of the image bearing member which has the third lowest electric potential, (h) to perform a third uniform exposure at a wavelength whose transmission factor is lowest for each of the first toner, the second toner, and the third toner, and (i) to develop a portion of the image bearing member which has the fourth lowest electric potential.

7 Claims, 11 Drawing Sheets

U.S. PATENT DOCUMENTS

| | | | | |
|---|---|---|---|---|
| 6,785,490 | B2 | 8/2004 | Tsukamoto et al. | |
| 6,901,231 | B1 | 5/2005 | Sakai et al. | |
| 6,947,691 | B2 | 9/2005 | Miyaguchi et al. | |
| 7,024,142 | B2 | 4/2006 | Sakai et al. | |
| 2003/0049048 | A1* | 3/2003 | Yoshikawa et al. | 399/129 |
| 2004/0240907 | A1 | 12/2004 | Miyaguchi et al. | |
| 2005/0008415 | A1* | 1/2005 | Tanaka et al. | 399/358 |
| 2005/0025525 | A1 | 2/2005 | Horike et al. | |
| 2005/0153222 | A1* | 7/2005 | Sugimura | 430/58.85 |
| 2005/0158073 | A1 | 7/2005 | Nakazato et al. | |
| 2005/0277048 | A1* | 12/2005 | Tomita | 430/110.3 |

FOREIGN PATENT DOCUMENTS

| | | |
|---|---|---|
| JP | 59-121077 | 7/1984 |
| JP | 59-121356 | 7/1984 |
| JP | 59-34310 | 8/1984 |
| JP | 60-225855 | 11/1985 |
| JP | 3-202868 | 9/1991 |
| JP | 3-219260 | 9/1991 |
| JP | 3073126 | 6/2000 |
| JP | 3170901 | 3/2001 |
| JP | 2003-202752 | 7/2003 |

OTHER PUBLICATIONS

U.S. Appl. No. 12/176,054, filed Jul. 18, 2008, Kadota, et al.
U.S. Appl. No. 12/209,812, filed Sep. 12, 2008, Aoki, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.

* cited by examiner

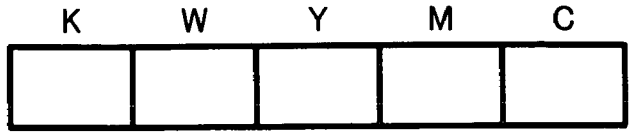
FIG. 9A
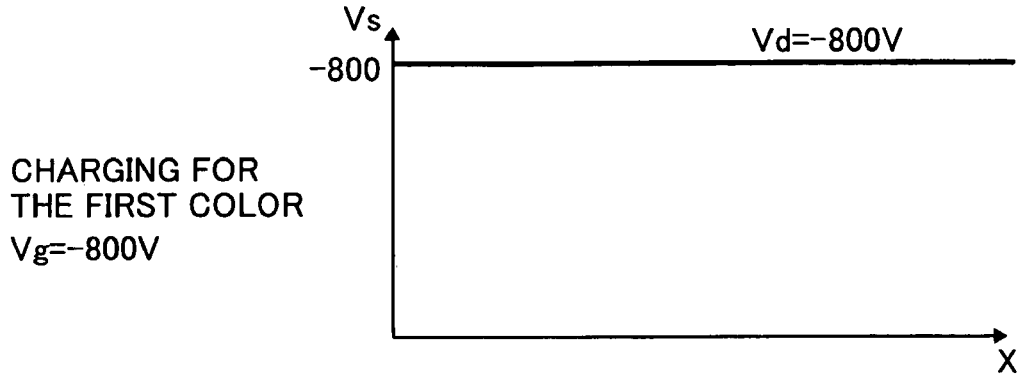
FIG. 9B
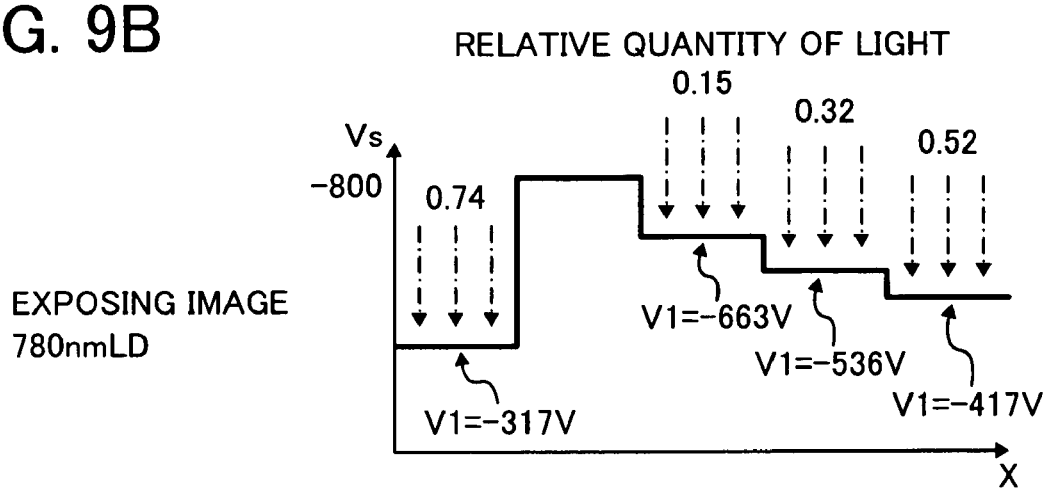
FIG. 9C
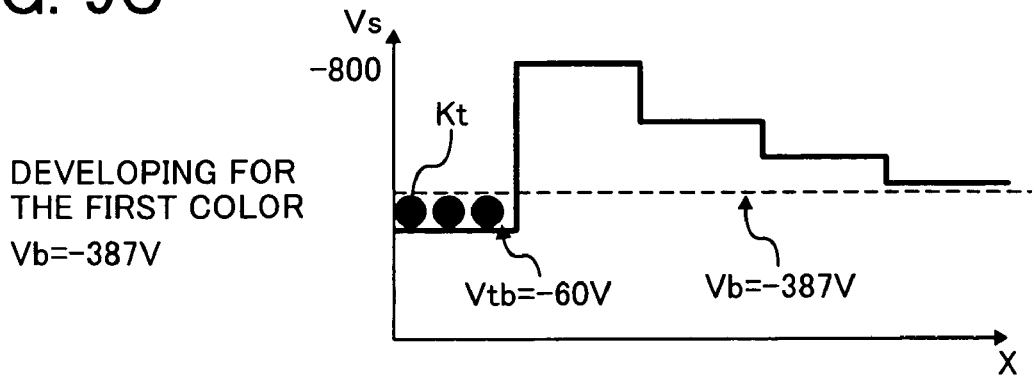

IMAGE FORMING APPARATUS FOR FORMING A COLOR IMAGE, AND IMAGE FORMING METHOD FOR FORMING A COLOR IMAGE

CROSS REFERENCE TO RELATED APPLICATIONS

This application claims the benefit under 35 USC 119 to Japanese application No. 2005-203537 filed on Jul. 12, 2005, the entire contents of which are hereby incorporated by reference.

BACKGROUND OF INVENTION

1. Field of the Invention

This invention relates generally to an image forming apparatus configured to form a full-color image by superimposing colors with a one time charge of an image bearing member.

2. Discussion of the Background

An image forming apparatus, such as a printer, a facsimile machine, a copy machine, a plotter, or a printer/facsimile/copy combination machine is known to form an image according to the following electrophotographic process: charging an image bearing member (hereinafter referred to as "photoconductor"), forming an electrostatic latent image, developing the image by adhering powder (e.g. "toner particle") to the electrostatic latent image, and transferring the toner image to a medium. Further, electrostatic stylus recorders are another type of image forming apparatus which forms a latent image of electric potential difference on an image bearing member. In this type of image forming apparatus, dielectric material is used as the image bearing member.

Currently, for an image forming apparatus which uses an electrophotographic process, there are two different types of processes that superimpose color on color. One type involves rotating one image bearing member four times. During each rotation, the following steps occur: applying a uniform electrostatic charge to the photoconductor, exposing an image, developing the image with any one of the color toners (cyan, magenta, yellow, black), and transferring the developed image to their respective locations on an intermediate transfer member or recording medium. In the second type process, four photoconductors laterally arranged with respect to each other are used to superimpose color on color. For each photoconductor, the following steps occur: applying a uniform electrostatic charge, exposing an image, developing the an image with any one of the color toners (cyan, magenta, yellow, black), and transferring the developed image on each photoconductor to their respective locations on an intermediate transfer member or a recording medium.

However, the one photoconductor/four rotations type process has a slow printing speed and the laterally arranged four photoconductors type process (i.e., the tandem type process) requires a large and complicated structure, and a high cost.

In light of these deficiencies, a third process has been designed. This type of process superimposes color toner on other color toner during a single rotation of one photoconductor (hereinafter referred to as "one photoconductor/one rotation superimposing type process"). There is also a method for superimposing different color toners on the surface of photoconductor by rotating a single photoconductor four times; however, this type of process has a problem of slow printing. In order to distinguish the process of rotating one photoconductor four times and transferring every color toner image per rotation, and the process of superimposing multiple color toners on the photoconductor without transferring every toner image, the former is referred to as one photoconductor/four rotations/transfer type process and the latter is referred to as one conductor/four rotations/superimpose type process.

In the above described one photoconductor/one rotation superimpose type process, by way of example, four sets of devices are arranged on the side of a belt-shaped or drum-shaped photoconductor. Each set forms a toner image on the photoconductor including, cyan, magenta, yellow, and black. Each set has two uniform charging devices (charging apparatuses) that are corona charging devices, an image exposing device (exposing apparatus), and an image developing device (developing apparatus). Unlike in the case of the one photoconductor/four rotations type process or the laterally arranged four photoconductors type process, this process is completed without transferring the image formed on the photoconductor to the recording medium or the intermediate transfer member. That is, the uniform charging, exposing, and developing are performed for the image on the photoconductor, and then the image of the four superimposed colors is formed in the identical position on the photoconductor.

Consequently, four uniform charges and four image exposures are required and hence miniaturization of an apparatus or lower costs is not substantially obtained. Moreover, speed detection and feedback control in order to obtain less color shift is required and hence the cost is elevated.

Consequently, there is another type of exposing method. This method is called "one shot exposing". In the one shot exposing process, a latent image of three or four colors is written at one time after a single charging step. The one shot process enables formation of an image without color shift, without speed detection, and without feedback controls which require higher cost.

Japanese published examined application 03-43621 (document 1), Japanese Laid open patent 03-202868 (document 2), and Japanese Laid open patent 03-219260 (document 3) disclose multi-layered photoconductors made with materials which have sensitivity to RGB, respectively, for performing the above described one shot exposing.

Further, Japanese Laid open patent 59-121077 (document 4) discloses a three-layered photoconductor including a photo-sensitive layer which is covered by a transparent insulating layer. Japanese published examined application 59-034310 (document 5), and Japanese Laid open patent 60-225855 (document 6) disclose a mosaic photoconductor which has filter layers of RGB.

In contrast thereto, in Japanese Laid open patent 54-82242 (document 7) a method using an ordinary photoconductor is disclosed. In this method, a latent image which has n levels of electric potential difference is formed by exposing an image, and the latent image is developed as superimposing toners using different developing biases with different toner according to the level. In this instance, as shown in FIG. 8, on the first developed toner, three other toners are formed. However, document 7 explains that the first developed toner of each level comes to the top after the transferring process so that a multi-color image made of the toner color is realized.

Moreover, in the field of conventional image forming apparatuses, the following documents are known. Japanese Laid Open Publication No. 2003-202752 (document 8) discloses a developing device that transports toner with a phase-shift electric field for developing, and Japanese Patent No. 3385008 (document 9) discloses an example of a charging device that charges with a scorotron charging device.

As mentioned in documents 1-6, the above-described apparatuses require use of special kinds of photoconductors. Consequently, these apparatuses are extremely expensive and are not durable and hence cannot be put into practical use.

In contrast thereto, when using an ordinary photoconductor as described in document 7, when using dry type toner, upper and lower toner layers mix and are fused for fixing. As a result, in view of the subtractive color process, a color of the upper toner does not reappear. However, developing color using mixed colors is possible, but in that case, all of the toners become mixed colors, except for the fourth and last one. Consequently, the original color of these toners cannot reappear and forming the full color image is impossible.

SUMMARY OF THE INVENTION

In view of the foregoing, an object of the present invention is to provide an image forming apparatus and method to form full-color or multi-color images using a novel one shot exposing process with an ordinary photoconductor.

To that end, among others, the present invention provides an image forming apparatus configured (a) to charge uniformly an image bearing member once, (b) to form a latent image including n levels of electric potential on the image bearing member with a single exposure, (c) to adhere a first toner on a portion of the image bearing member which has the lowest electric potential in absolute value, (d) to decrease the electric potential of a portion of the image bearing member not developed with the first toner by uniformly exposing light at a first wavelength whose transmission factor is lowest for the first toner, (e) to develop using a second toner a portion of the image bearing member which has the second lowest electric potential, (f) to perform a second uniform exposure at a wavelength whose transmission factor is lowest for both the first toner and the second toner, (g) to develop using a third toner a portion of the image bearing member which has the third lowest electric potential, (h) to perform a third uniform exposure at a wavelength whose transmission factor is lowest for each of the first toner, the second toner, and the third toner, and (i) to develop a portion of the image bearing member which has the fourth lowest electric potential.

It is preferable that a transmission factor of the first toner is the highest of four kinds of toner. In this instance, it is preferable that the first toner is black toner. In addition, it is preferable that a photosensitive layer thickness of the image bearing member is less than the size of one dot. Further, it is preferable that a light carrier generating region of the image bearing member exists on the surface of the photosensitive layer. Furthermore, it is preferable that a combination of black, cyan, magenta, and yellow is used to form the color image.

The present invention further provides an image forming method for forming a multi-color image on an image bearing member using at least two kinds of color toner, including the steps of: charging uniformly the image bearing member once; forming a latent image including n levels of electric potential on the image bearing member with a single exposure; adhering one kind of toner to a portion of the image bearing member which has the lowest electric potential; decreasing an electric potential of a portion of the image bearing member not developed with toner by uniformly exposing with light at a wavelength whose transmission factor is low for the toner adhered on the image bearing member; and developing the second kind of toner on a portion of the image bearing member which has the second lowest electric potential.

The present invention further provides that the forming step can be an electrostatic method.

It is preferable that the developing step is performed by making toner in a powder cloud state. In addition, it is preferable that the developing step is performed by making the toner hop with a phase shift electric field which is called the EH development method.

The present invention further provides an image forming method for forming color images on an image bearing member using at least four kinds of color toner, including the steps of: charging uniformly the image bearing member once; forming a latent image including n levels of electric potential on the image bearing member with a single exposure; adhering the first toner on a portion of the image bearing member which has the lowest electric potential; decreasing an electric potential applied to a portion of the image forming member not developed with the first toner by uniformly exposing with light at a wavelength whose transmission factor is low for the first toner; developing a portion of the image bearing member which has the second lowest electric potential with the second toner; performing a second uniform exposure at a wavelength whose transmission factor is low for both the first toner and the second toner; developing a portion of the image bearing member which has the third lowest electric potential with the third toner; performing a third uniform exposure at a wavelength whose transmission factor is low for each of the first toner, the second toner, and the third toner; and developing a portion of the image bearing member which has the fourth lowest electric potential with the fourth toner.

The present invention further provides an image forming apparatus for forming color image on an image bearing member using at least four kinds of color toner, including: a charging device configured to uniformly charge the image bearing member; an exposing device configured to form a latent image including n levels of electric potential on the image bearing member charged by the charging device with a single exposure; at least four developing devices each configured to develop the latent image with a kind of toner; at least three uniformly exposing devices each configured to uniformly expose the image bearing member; wherein a first developing device of the at least four developing devices is configured to adhere the first toner to a portion of the image bearing member which has the lowest electric potential; wherein a first uniformly exposing device of the at least three uniformly exposing devices is configured to decrease the electric potential of a portion of the image bearing member not developed with toner by uniformly exposing with light at a wavelength whose transmission factor is low for the first toner adhered on the image bearing member; wherein a second developing device of the at least four developing device is configured to adhere the second toner to a portion which has the second lowest electric potential; wherein a second uniformly exposing device of the at least three uniformly exposing devices is configured to decrease the electric potential of a portion of the image bearing member not developed with any kinds of toner by uniformly exposing with light at a wavelength whose transmission factor is low for both the first toner and the second toner adhered on the image bearing member; wherein a third developing device of the at least four developing devices is configured to adhere the third toner to a portion of the image bearing member which has the third lowest electric potential; wherein a third uniformly exposing device of the at least three uniformly exposing devices is configured to decrease of the electric potential of a portion of the image bearing member not developed with any kinds of toner by uniformly exposing with light at a wavelength whose transmission factor is low for all of the first toner, the second toner, and the third toner adhered on the image bearing member; and wherein a fourth developing device of the at least four developing devices is configured to adhere the fourth toner to a portion of the image bearing member which has the fourth lowest electric potential.

The present invention further provides an image forming apparatus for forming a color image on an image bearing member using at least two kinds of color toner, including: a charging device configured to uniformly charge the image bearing member; an exposing device configured to form a latent image including n levels of electric potential on the image bearing member charged by the charging device with a single exposure; n developing devices each configured to develop the latent image with a kind of toner; (n-1) uniformly exposing devices each configured to uniformly expose the image bearing member; wherein a first developing device of the n developing devices is configured to adhere the first toner to a portion of the image bearing member which has the lowest electric potential; wherein one of the (n-1) uniformly exposing devices is configured to decrease the electric potential of a portion of the image bearing member not developed with toner by uniformly exposing at a wavelength whose transmission factor is low for the toner adhered on the image bearing member; wherein one of the n developing devices is configured to adhere the second toner to a portion of the image bearing member which has the second lowest electric potential.

BRIEF DISCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIG. 1 schematically shows an image forming apparatus for forming color images according to the present invention.

Figure 5:
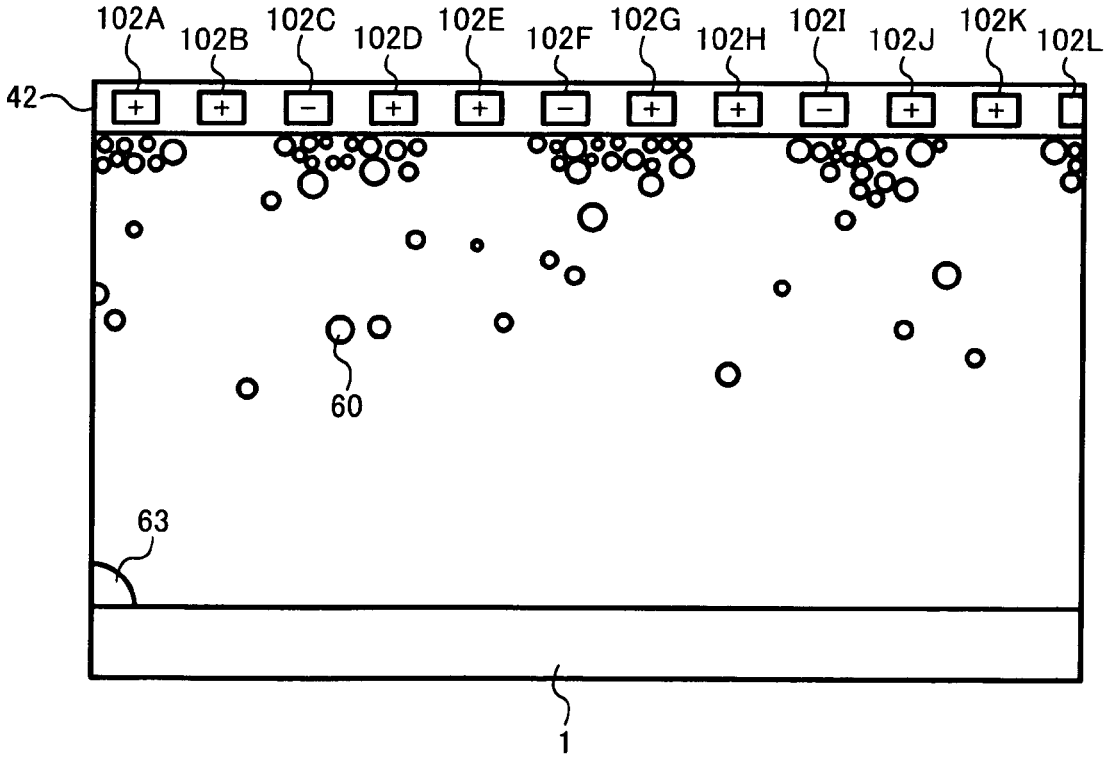

FIG. 5 schematically shows a simulated time change of toner position in EH development.

Figure 6:
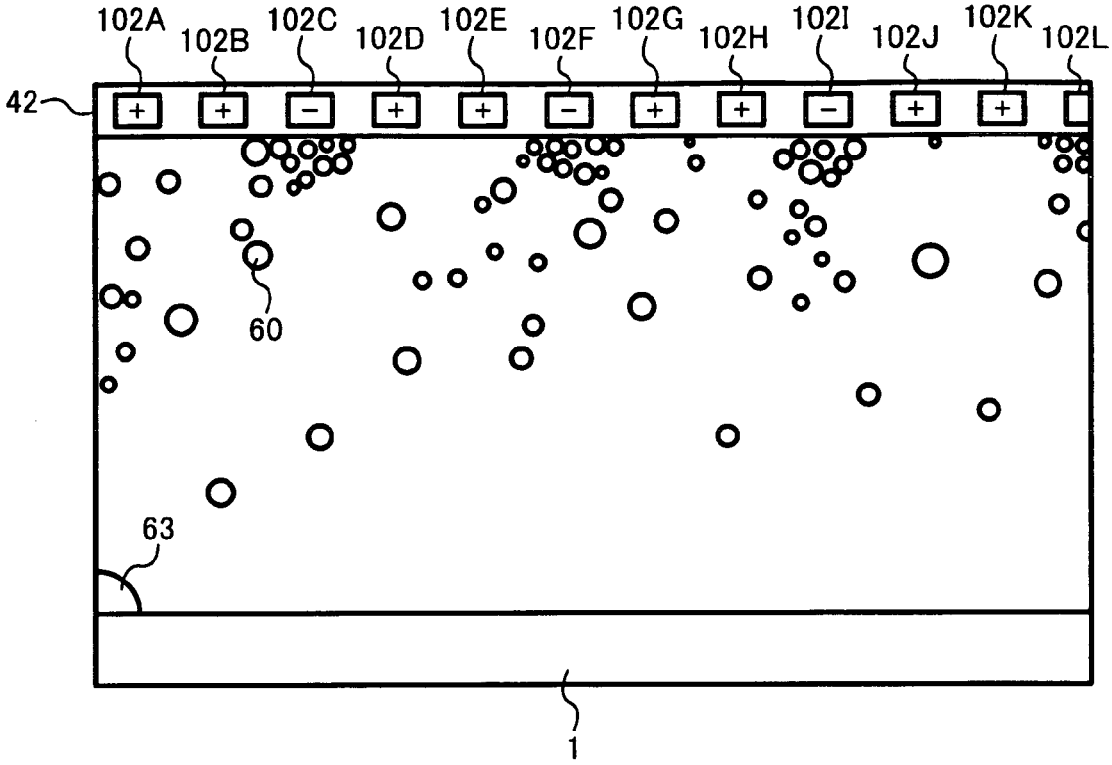

FIG. 6 schematically shows a simulated time change of toner position after FIG. 5.

Figure 7:
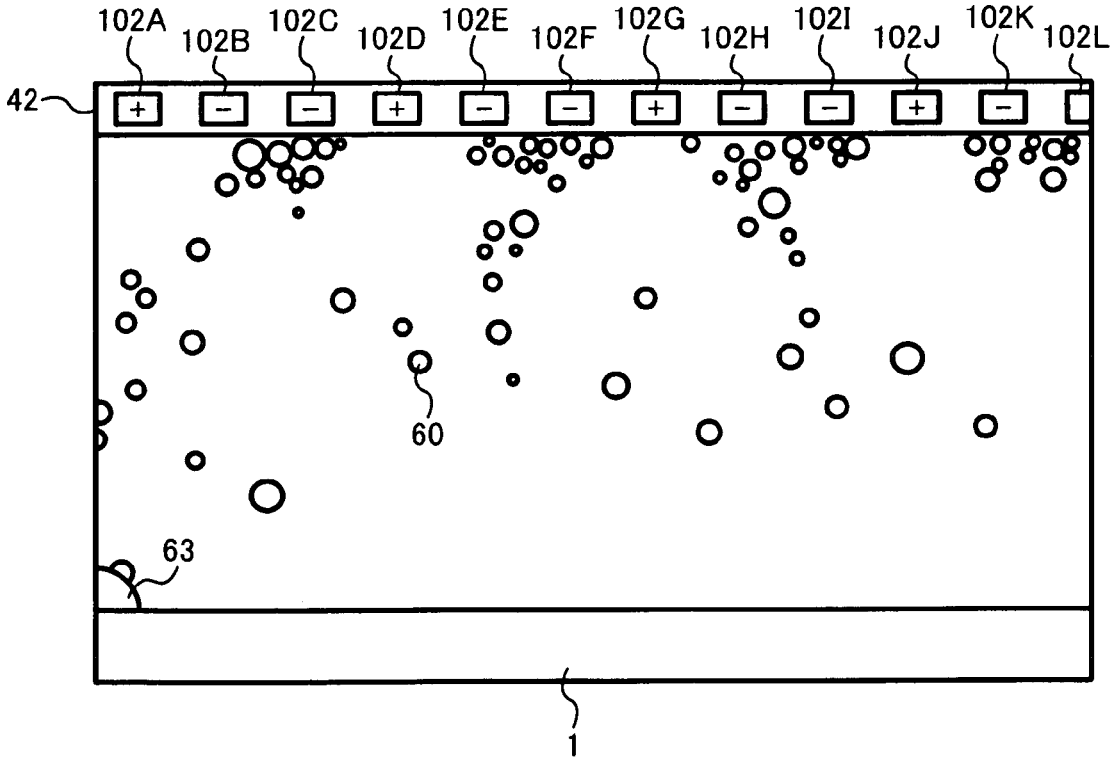

FIG. 7 schematically shows a simulated time change of toner position after FIG. 6.

Figure 8:
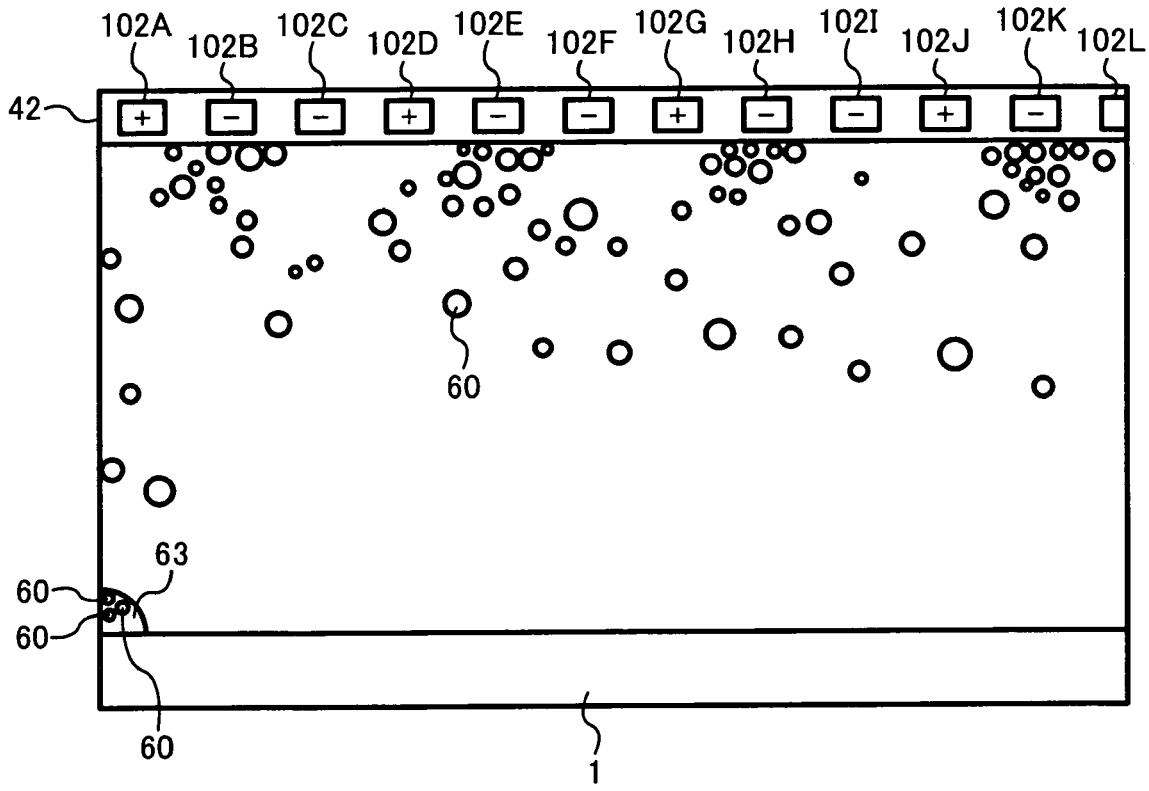

FIG. 8 schematically shows a simulated time change of toner position after FIG. 7.

FIG. 9 schematically shows forming an image of a first color when the image forming apparatus forms a color image using a superimpose type process.

Figure 10:
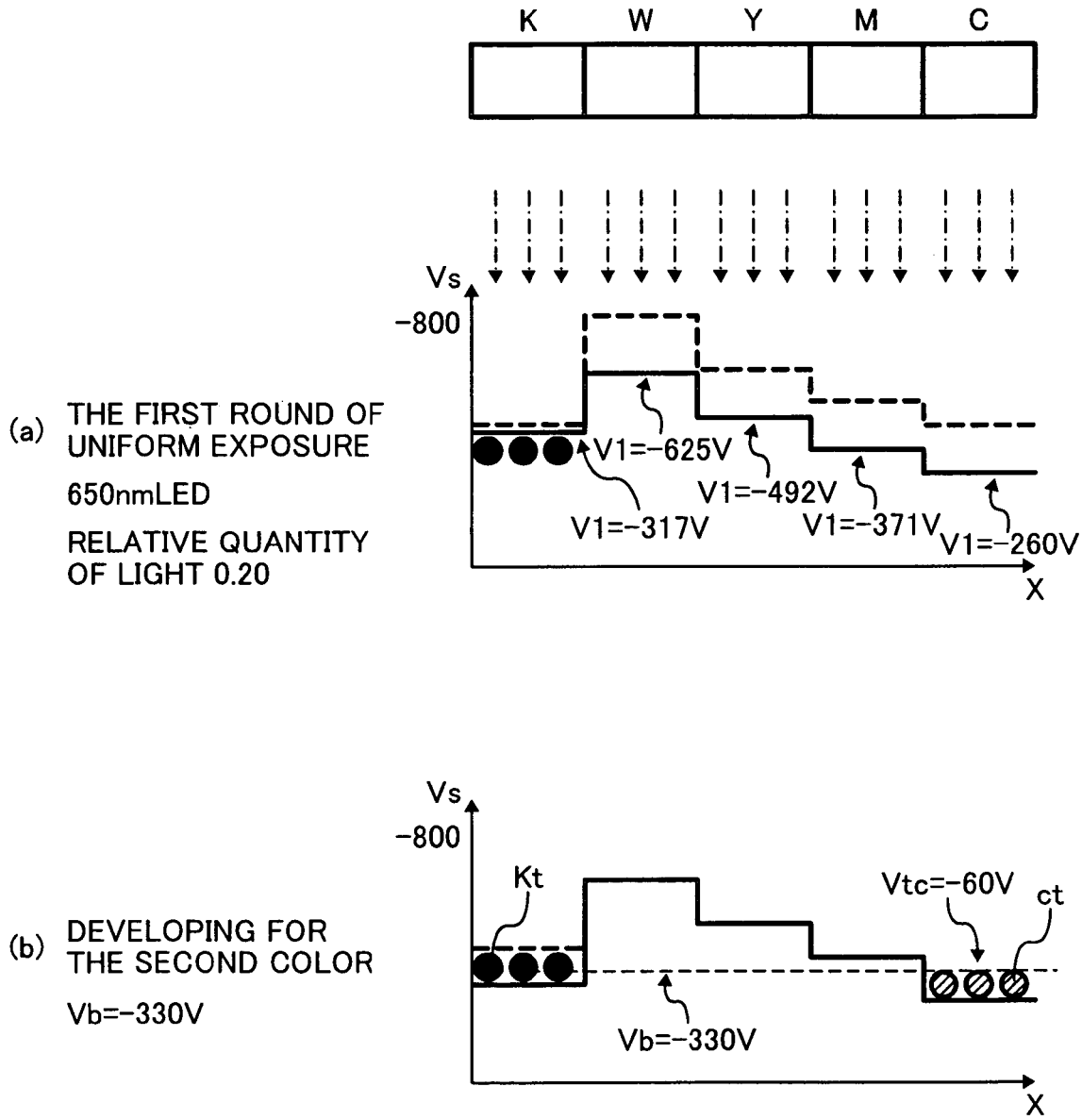

FIG. 10 shows forming an image of a second color when the image forming apparatus forms the color image using the superimpose type process.

Figure 11:
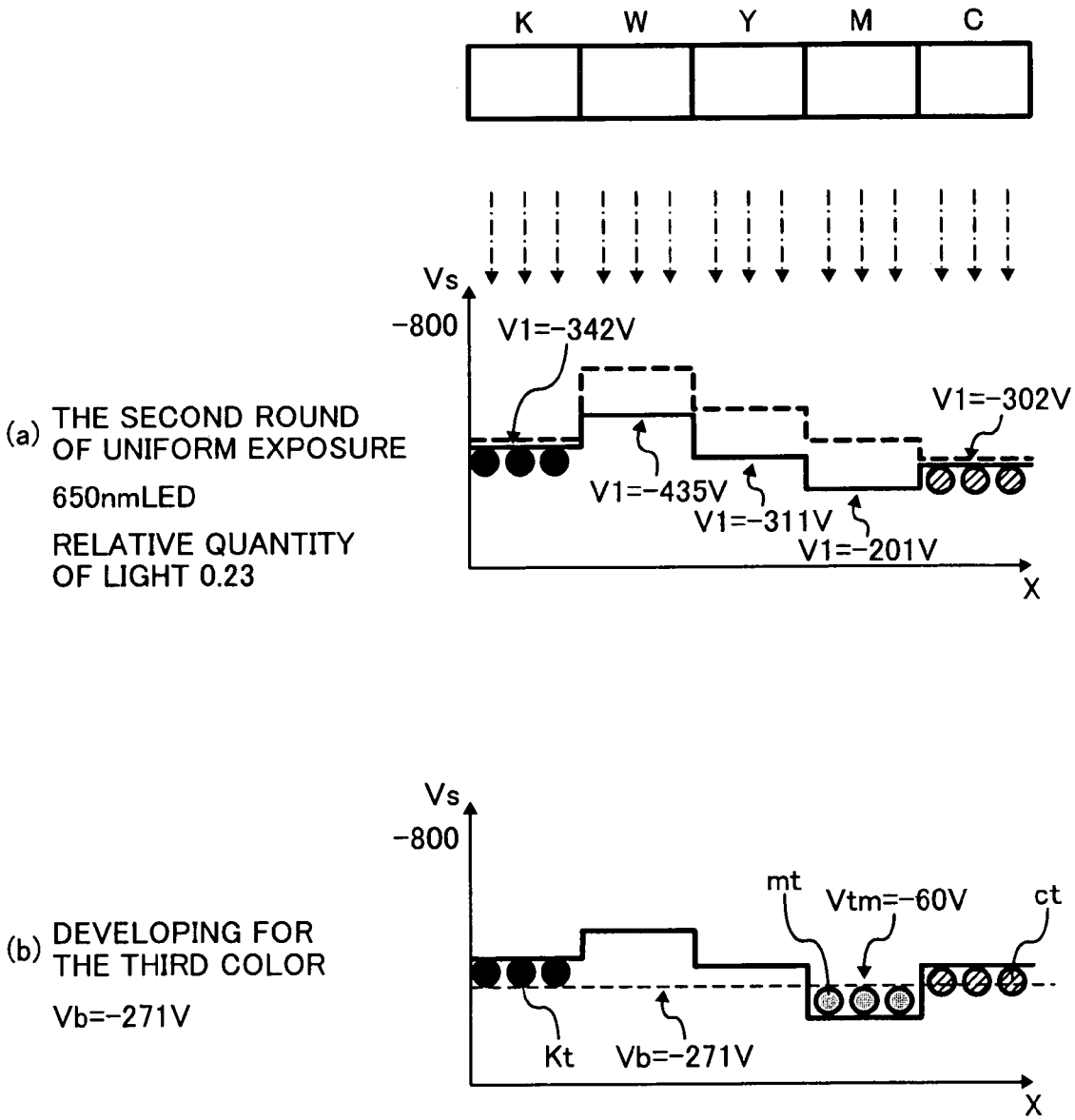

FIG. 11 shows forming an image of a third color when the image forming apparatus forms the color image using the superimpose type process.

Figure 12:
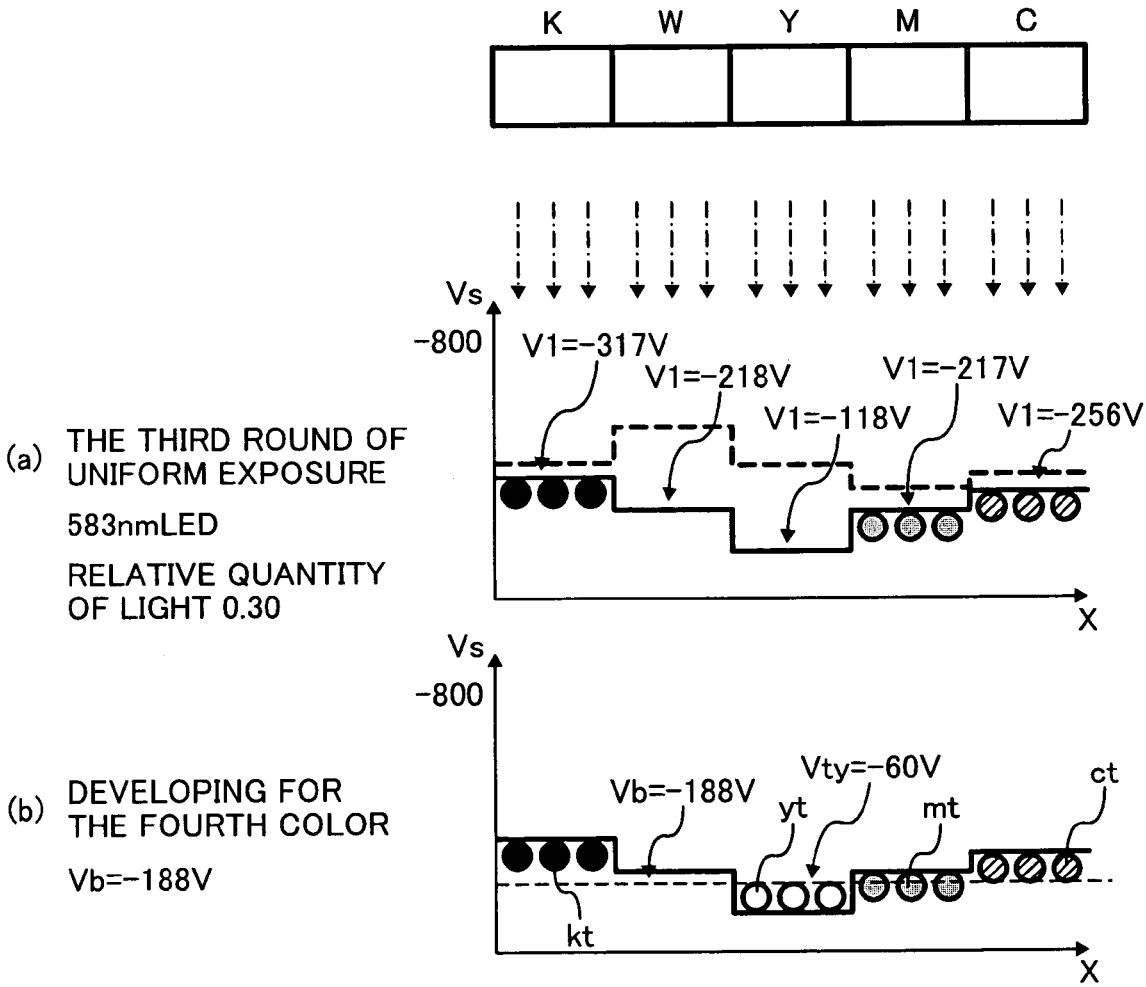

FIG. 12 shows forming an image of a fourth color when the image forming apparatus forms the color image using the superimpose type process.

Figure 13:
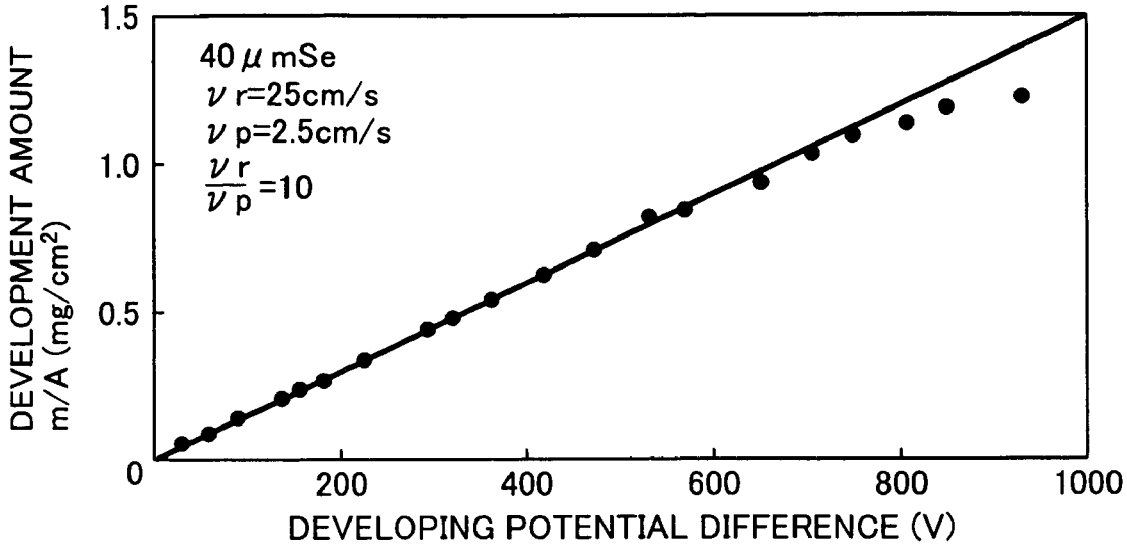

FIG. 13 shows a development amount m/A per unit area of toner for a development potential difference using a conventional developing method.

Figure 14:
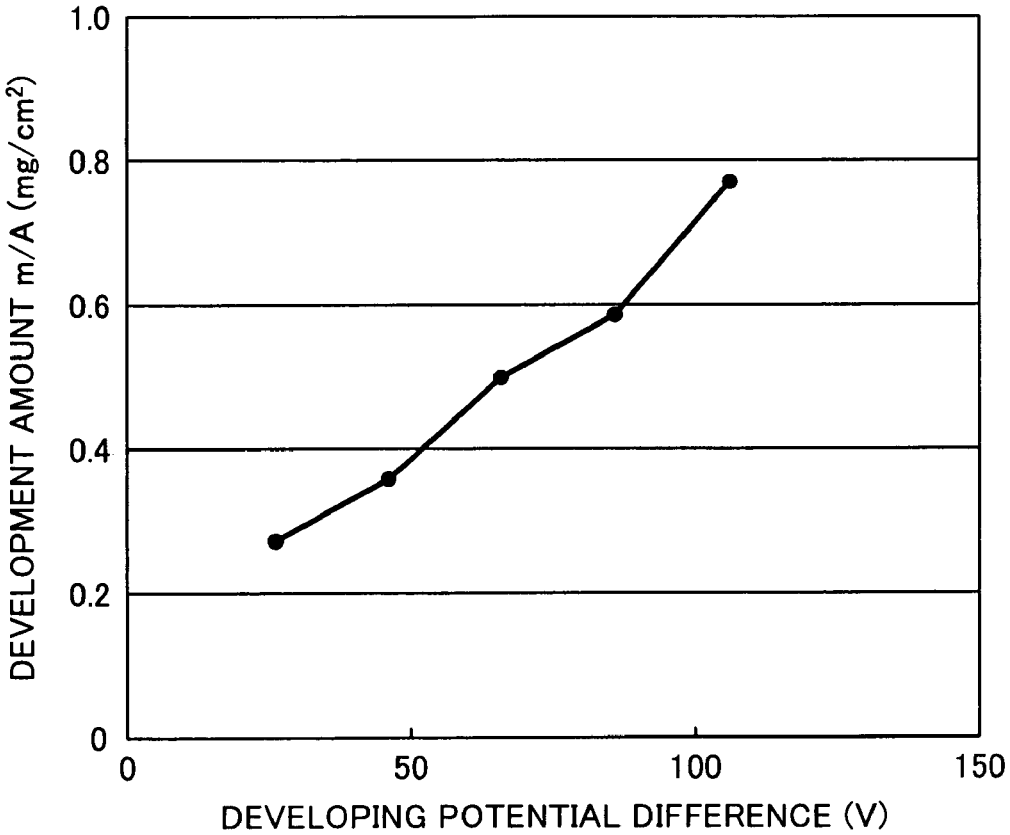

FIG. 14 shows a development amount m/A per unit area of toner for a development potential difference using the EH developing method.

DESCRIPTION OF THE PREFERRED EMBODIMENT

Figure 1:
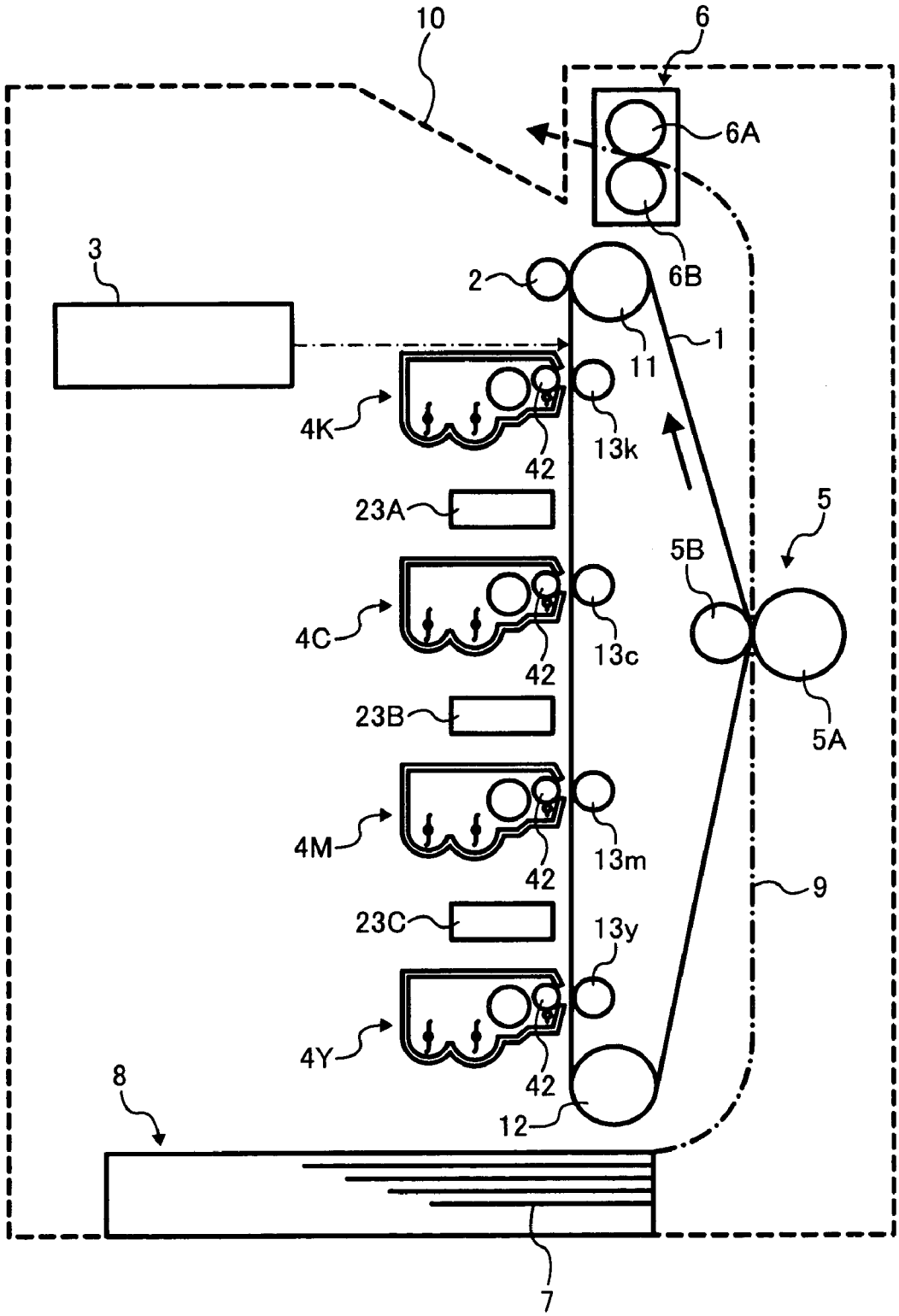
Figure 2:
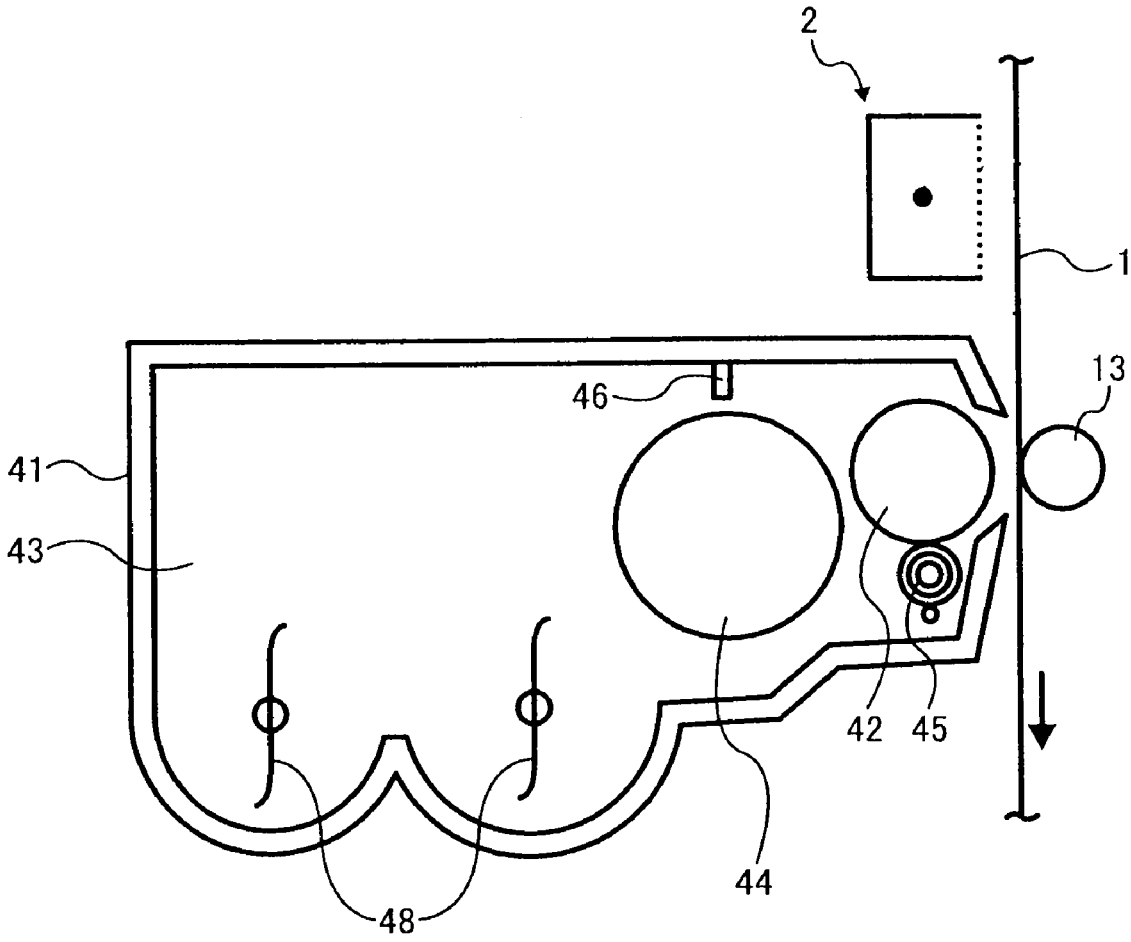
FIG. 2 shows a developing device of the image processing apparatus.

Embodiments of the present invention are described in detail in conjunction with the attached drawings. FIG. 1 and FIG. 2 schematically show an image forming apparatus configured to form full-color images. FIG. 1 schematically shows an image forming apparatus configured to form color images of the present invention, and FIG. 2 shows a developing device of the image processing apparatus.

The image forming apparatus includes a belt-shaped photo-sensitive conductor (OPC: organic photoconductor) as an image bearing member 1; a contact-type charging roller 2 as a contact-type charging apparatus (a charging device) used to charge uniformly the image bearing member 1; a writing apparatus used to form a latent image on the image bearing member 1, a developing apparatus 4K used to adhere black toner and develop a latent image which is formed on the image bearing member by a writing apparatus 3K; a uniformly exposing device 23A used to expose uniformly the image bearing member 1 developed by the developing apparatus 4K; a developing apparatus 4C used to develop by adhering cyan toner to the latent image on the image bearing member 1; a uniformly exposing device 23B used to expose uniformly the image bearing member 1 developed by the developing apparatus 4C; a developing apparatus 4M used to develop by adhering magenta toner to the latent image on the image bearing member 1; a uniformly exposing device 23C used to expose uniformly the image bearing member 1 developed by the developing apparatus 4M; a developing apparatus 4Y used to develop by adhering yellow tone to the latent image on the image bearing member 1; a transferring apparatus 5 used to transfer a full-color toner image which is formed by superimposing each toner image on the image bearing member 1; a fixing apparatus 6; and a sheet feeding apparatus 8 used to house transfer material 7, the developing apparatus 4K, the uniformly exposing device 23A, the developing apparatus 4C, the uniformly exposing device 23B, the developing apparatus 4M, the uniformly exposing device 23C, and the developing apparatus 4Y located downstream of the writing apparatus 3 along the rotating direction of the image bearing member 1 (indicated by the arrow in FIG. 1) in order.

The image bearing member 1 is tensioned by a transferring roller 11, a driven roller 12, an opposite transferring roller 5B including a transferring apparatus 5, and opposite members 13Y, 13M, 13C, 13K that oppose the developing apparatuses 4Y, 4M, 4C, 4K respectively. The image bearing member 1 is rotated in the direction indicated by the arrow at a rate of 100 mm/sec, for example, by rotation of the transferring roller 11. In addition, the developing apparatuses are collectively referred to as the developing apparatus 4 when they are not distinguished based on color. Further, as the image bearing member 1 a seam less OPC photoconductor belt including a photo-sensitive layer having a thickness of 20 micrometers is used.

The charging roller 2 is a contact type charging roller 16 mm in diameter which is formed by layered rubbers 3 mm thick. The amount of resistance of the rubbers is adjusted by addition of black carbon.

The writing apparatus 3 writes a latent image which has n levels of different electric potential on the image bearing member 1 which has been charged uniformly once by the charging roller 2. Various sorts of devices can serve as the writing apparatus including, for example, a light scanning apparatus using a laser, LED array, etc. Here, each writing apparatus has one 5 mW laser diode, and modulates the intensity of exposure according to each pixel (i.e., power modulation). The printing density is 1200 dpi and the size of one dot is about 28 micrometers.

The uniformly exposing devices 23A, 23B, and 23C uniformly expose the image bearing member 1. Any light source, whose wavelength is appropriate, can be used for the uniformly exposing devices. In this embodiment, an LED which emits at 650 nanometers and 583 nanometers is used. In this instance, the uniformly exposing device 23A decreases an absolute value of an electric potential of a portion not developed with black toner by exposing with light whose wavelength has a low transmission factor for black toner. The uniformly exposing device 23B decreases an absolute value of an electric potential of a portion not developed with black toner and cyan toner by exposing with light whose wavelength has a low transmission factor for black toner and cyan toner.

The uniformly exposing device 23C decreases an absolute value of an electric potential of a portion not developed with black toner, cyan toner, and magenta toner by exposing with light whose wavelength has a low transmission factor for black toner, cyan toner, and magenta toner.

The transferring apparatus 5 includes the transferring roller 5A and the opposite transferring roller 5B. The fixing apparatus 6 has a heat roller 6A and a pressure roller 6B located on the opposite side of the heat roller 6A. As the transferring roller 5A, for example, a roller formed by covering a metal roller, with a semi-conductive rubber layer 3 mm thick can be used. The transferring roller 5A is applied 500 volts for transferring.

In case the image forming apparatus serves as a copier, image information loaded from a scanner (not shown) is converted to write data and is treated with various sorts of image data processing, for example, A/D exchange, MTF correction, gray-scale processing, etc. In case the image forming apparatus serves as a printer, image information such as a page-description language or bit-mapped image data etc., is converted to write data and treated with various sorts of image data processing.

Prior to image formation, the image bearing member 1 starts to rotate in the direction of the arrow in FIG. 1 in order that the rotation speed of the surface movement speed reaches a determined level. Then at the proper moment, the image bearing member 1 is charged uniformly by the charging roller 2 once. Further, a latent image which has n levels of electric potential differences is written on the charged image bearing member 1 by the writing apparatus 3 with proportionate exposing intensities for each color.

After the charging phase, the developing apparatus 4K adheres black toner, which is the first developed toner, to a portion of the image bearing member having the lowest electric potential (in absolute value) in a reverse development method. Thereafter, the uniformly exposing device 23A decreases the absolute value of electric potential of a portion of the image bearing member 1 not developed with the first developed toner (black toner) by uniformly exposing with light whose wavelength has a low transmission factor for black toner. Then, the developing apparatus 4C adheres cyan toner to a portion of the image bearing member having the lowest electric potential (absolute value).

Subsequently, the uniformly exposing device 23B uniformly exposes the image bearing member 1 with light whose wavelength has a low transmission factor for both the first toner (black toner) and the second toner (cyan toner). Then, the developing apparatus 4M adheres the magenta toner to a portion of the image bearing member having the lowest electric potential (absolute value). Finally, the uniformly exposing device 23C uniformly exposes the image bearing member 1 with light whose wavelength has a low transmission factor for all of the first toner (black toner), the second toner (cyan toner), and the third toner (magenta toner). The developing apparatus 4Y adheres the yellow toner to a portion of the image bearing member having the lowest electric potential (absolute value).

After the reverse development method just described is complete, a transfer material 7 is fed from a sheet feeder 8, and carried through a feed route 9. Then, the toner image formed on the image bearing member 1 is transferred to the transfer material 7. The fixing apparatus 6 fixes the full-color image on the nodes for material 7 and the transfer material 7 is ejected to a paper ejection part 10.

FIG. 2 illustrates the details of a single developing apparatus 4. The developing device 4 has an electrostatic transporting member (hereinafter referred to as "electrostatic transporting roller") 42 that is sleeve-shaped, a housing part 43 where toner is stored, a supplying roller (a developer bearing member) 44 which supplies the electrostatic transporting roller 42 with toner particles in the housing part, and a recovery roller 45 used to recover the toner carried by the electrostatic transporting roller 42. The above device is contained in a case 41. Further, the electrostatic transporting roller 42 operates to transfer a powdered state toner by means of a phase-shifted electric field for developing the electrostatic latent image formed on the image bearing member 1.

The supplying roller 44 includes a magnet inside the roller. The developer in the housing part 43 is supplied to the surface of the supplying roller 44 by the rotation and magnetic attraction of the supplying roller 44 and an agitate screw 48. The thickness of the developer on the supplying roller 44 is restricted to a given quantity by a developer layer thickness controlling device 46 placed opposite the circumference of the supplying roller 44. The developer supplied by the supplying roller 44 is carried to the region opposite the electrostatic transporting roller 42 as a consequence of the rotation of the supplying roller 44.

The supplying roller 44 is applied an electric potential by means of a voltage applying device (not shown). The electrostatic transporting roller 42 is applied an electric potential for forming the transporting electric field by means of a voltage applying device (a driving circuit) that is described later.

With such an operation, an electric field between the electrostatic transporting roller 42 and the supplying roller 44 is created in a region where the supplying roller 44 faces the electrostatic transporting roller 42. Receiving the electrostatic force from this electric field, the negatively charged toners dissociate from carriers, and then move toward the surface of the electrostatic transporting roller 42. The toners that successfully reach the surface of the electrostatic transporting roller 42 are transported by hopping on the surface of the electrostatic transporting roller 42 by means of the transporting electric field (phase shift electric field) formed by the voltage applied to the electrodes of the roller 42. In this invention, the method of supplying charged toners to the electrostatic transporting roller 42 is not limited to the above described bi-component type development. Alternative methods of development are available. For example, a mono-component type, charge-injection type, or pre-charged toners can be used.

During image processing, the electrostatic transporting roller 42, which has a plurality of electrodes used to form the electric field for transferring, developing, and recovering toners, is placed opposite the image bearing member 1 in a non-contacting state with a nearest distance of 50-1000 micrometers, optimally 150-400 micrometers. In this embodiment, the distance is 300 micrometers.

Figure 3:
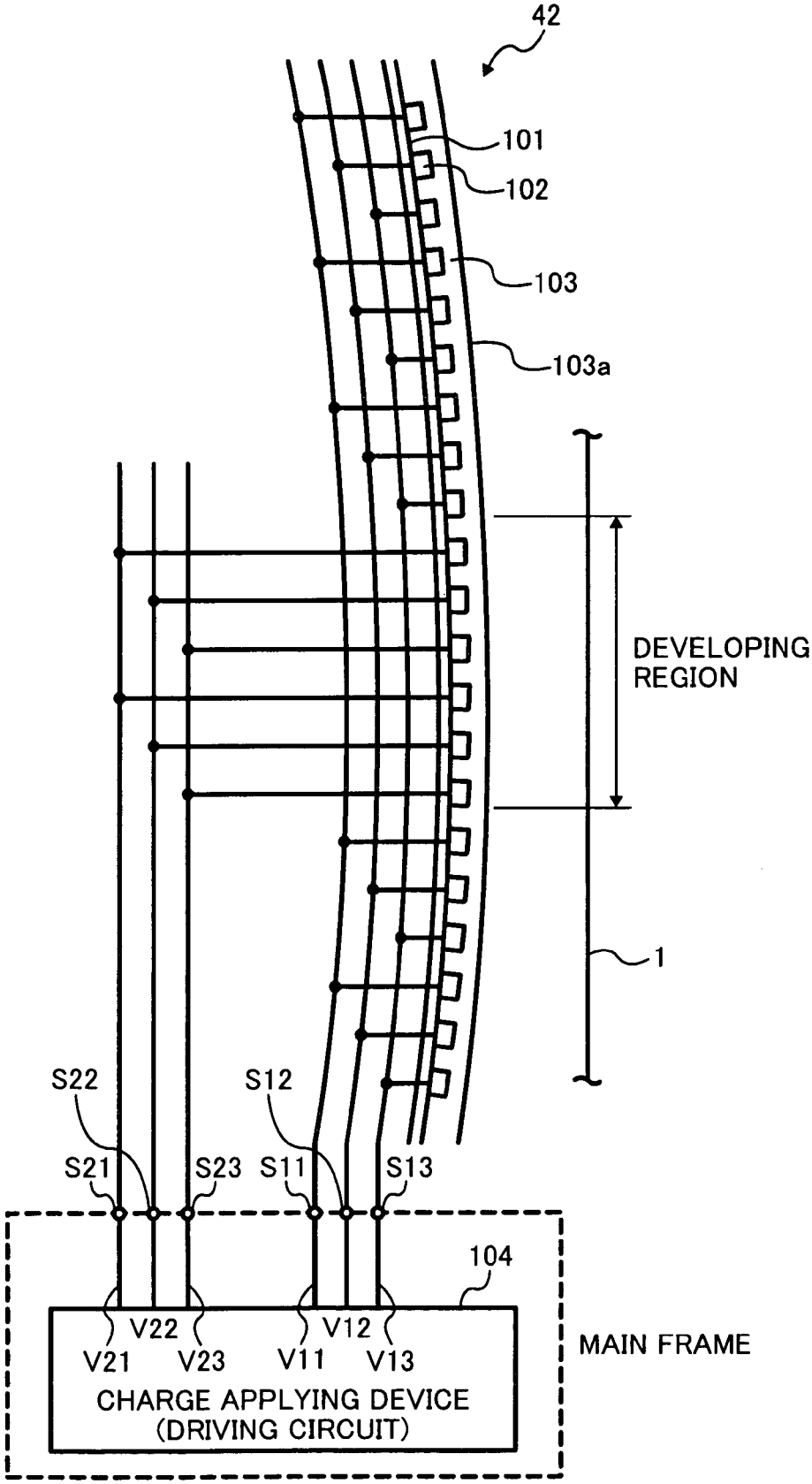
FIG. 3 shows an enlarged view of an electrostatic transporting roller.

FIG. 3 is an enlarged diagram showing the surface facing the image bearing member 1 of the above described electrostatic transporting roller 42. The electrostatic transporting roller 42 includes a plurality of electrodes 102 arranged on a support substrate 101 in sets of n along the direction for transporting toners. The top of each electrode is laminated with a surface protection layer 103 structured from inorganic or organic insulating material. The surface protection layer 103 serves as an insulating electrostatic transporting surface and has an electrostatic transporting surface 103*a*. The surface protection layer 103 also serves as a protection layer covering the surface of each electrode 102. In this embodiment, each electrode 102 is separated by 60 micrometers, and has a width of 30 micrometers.

As the above described support substrate 101, the following sorts of substrate can be used: a substrate structured from insulating substrate, for example, a resin substrate or ceramic substrate: a substrate structured from substrate made from material having conducting properties, for example, Steal USE Stainless (SUS), that is covered with insulting film, for example, SiO2; and a substrate structured from flexible material, for example, polyimide film. The electrode 102 is formed by forming conductive material film 0.1-10 micrometers thick, optimally 0.5-2.0 micrometers thick, and then developing a desired pattern of electrodes, for example, using a photolithographic technique. For example, Ni—Cr can be used as the conductive material. The surface protection layer 103 is formed by forming film 0.5-10 micrometers thick, optimally 0.5-3 micrometers thick. For example, $SiO_2$, $TiO_2$, $TiO_4$, SiON, BN, TiN, $Ta_2O_5$, can be used as the material for the protection layer 103.

In FIG. 3, lines projecting from the electrodes 102 are conducting wires used to apply voltage to each electrode 102. The nodes reflect which contact point of the developing apparatus 4 the corresponding electrode 102 is connected to. A driving circuit (a voltage applying device) 104 of a main frame applies n-phased driving voltages to each electrode 102 via the conducting device. In this embodiment, a three phase driving voltage is applied (m=3). However, any natural number satisfying m>2 may be applied on the condition that the toners are carried properly to the image bearing member 1.

In this embodiment, each electrode 102 is connected to one of contact points S11, S12, S13, S21, S22, or S23 of the developing apparatus 4. Contact points S11, S12, S13, S21, S22, and S23 are connected respectively to the voltage applying device 104 which applies driving waveforms V11, V12, V13, V21, V22, and V23, of the main frame on the condition that the developing apparatus 4 is loaded on the image processing apparatus.

The electrostatic transporting roller 42 carries toners to the proximity of the image bearing member 1. The electrostatic transporting roller 42 is divided into a development region used to form the toner image by adhering toner to the latent image on the image bearing member 1, and a transporting region used to recover toners that are transported to the transporting region without being used for development in the development region.

The development region exists only in the region of the roller 42 adjacent to the image bearing member 1, and the transporting region exists in the remaining area of the electrostatic transporting roller 42. In this embodiment, a region where toners are available to move via the phase-shift electric field is referred to as the "electrostatic transporting surface". In this embodiment, the whole surface of the electrostatic transporting roller 42 is the electrostatic transporting surface.

In the transfer region, driving waveforms V11, V12, and V13 are applied by the voltage applying device 104. In the development region, driving waveforms V21, V22, and V23 are applied by the electrodes 102.

The principle of electrostatic transporting of toner using the electrostatic transporting roller 42 according to the present invention is now described. Applying n-phased driving waveforms to the plurality of the electrodes 102 of electrostatic transporting roller 42 generates the phase shift electric field (traveling wave electric field). Then, the charged toners on the electrostatic transporting roller 42 are transferred by receiving the repulsive and/or attractive forces of the traveling wave electric field.

Figure 4:
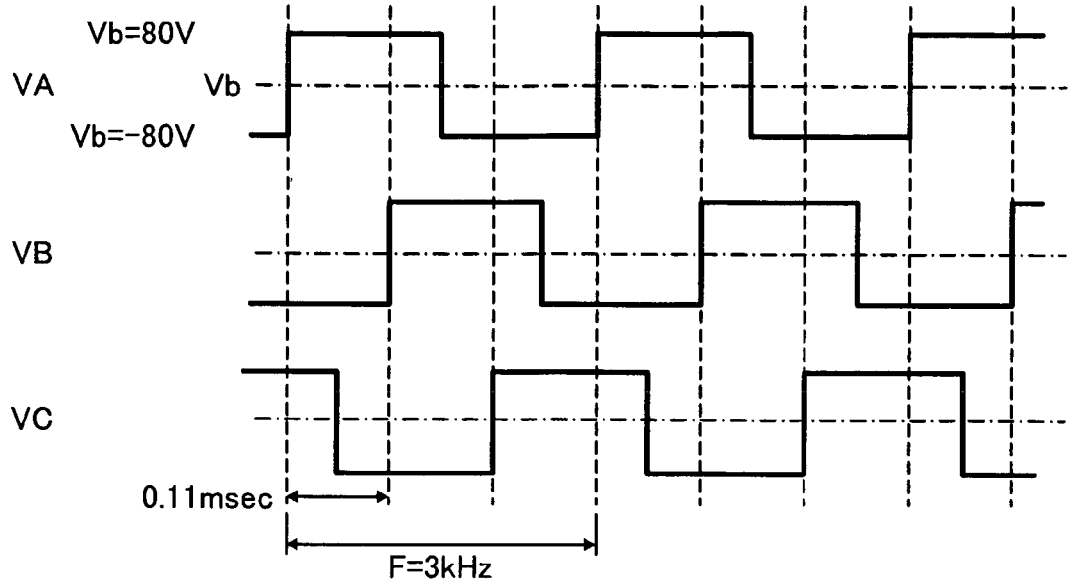
FIG. 4 shows a driving waveform applied to the electrostatic transporting roller.

For example, referring to FIG. 4, a three-phase voltage including phase A (VA), phase B (VB), and phase C (VC) is applied as a rectangular wave to three electrodes 102, respectively. The timing of the three-phase waveforms are shifted by 120 degrees. The rectangular wave has a peak-to-peak electric voltage of 160V (Duty=50%) and a frequency of 3 kHz. Then, the charged toner move over on the electrostatic transporting roller 42 while hopping in sync with the traveling wave electric field. The average amount VB of the traveling wave electric field operates similar to what is called the developing bias in the developing region. Phase A (VA), phase B (VB), and phase C (VC) correspond to the above described electric waveforms V11, V12, V13, V21, V22, and V23.

When the traveling wave electric field is applied, the height of toner hopping reaches 200-300 micrometers, so when the electrostatic latent image exists 300 micrometers from the electrostatic transporting roller 42, hopping toners enter into the electrical field formed by the latent image (image portion) of the image bearing member 1, travel toward the latent image, and then develop the latent image. As described above, the hopping toners are separated from carriers as they are not trapped by the carriers. In contrast, in portions of the latent image where toners are not to be applied, the latent image forms an electric field that generates force to repel toners. So, the toners, which travel toward non-image portions, make a U-turn in mid-course without reaching the image bearing member 1, and are recovered by the recovery roller 45. As described above, because development is performed with toners that are hopping by electrostatic transporting, this type of development is called Electrostatic Hopping development or, for short, EH development.

Referring to FIG. 5-FIG. 8, some processes in this type of development are described more particularly. These figures show the positions (simulated) of a toner 60 in the space formed by the image bearing member 1 and the electrostatic transporting roller 42.

On the OPC (the image bearing member 1), a negative latent image of 600 dpi where 1 dot is 42 micrometers is formed. In this embodiment the latent image consists of one isolated dot. When hopping toners reach a space extending above the latent image, they start to contribute to developing the latent image under the influence of an electric field formed by the latent image. This space is referred to as a development space 63. In addition, if the latent image is larger, the development space spreads to an upper area. On the other hand, the electrostatic transporting roller 42 is arranged with electrodes 102A-102L. The hopping toners 60, which are transported by this electrostatic transporting roller 42, have some variation in particle diameters and charge quantities. In these figures, this variation is depicted as circles having different sizes.

When the negative charged toner 60 reaches the space 63, the negative charged toner 60 move toward the image bearing member 1, land thereon, and then develop into a one dot latent image. That is, the toner 60 receives a force to orient itself relative to the image bearing member 1 in the space 63. In fact, as time advances as reflected in FIG. 5 to FIG. 8, it is realized that some toners which are hopped by the roller 42 reach the development space 63, and develop a latent image. At the same time, in non-image portions of the image bearing member 1, it is realized that hopping toner 60 are redirected to the recovery roller 45.

The phenomenon that hopping toners are drawn to the image portions, and are repelled in the non-image portions was confirmed using a high-speed camera. In this manner, EH development enables development of the current latent image without disturbing a previously formed latent image which corresponds to a non-image portion of the current latent image.

Next, referring to FIG. 9-FIG. 12, a process for full-color image forming using a one photoconductor/one rotation/one charge superimpose type process in the above-described image processing apparatus is described. The surface potential for five basic colors (original color: black, white, yellow, magenta, and cyan) in each process is explained using actual measurement values; however, some values which were unable to be measured are described using simulation values.

At first, as shown in FIG. 9A, the image bearing member 1 (referred to as "OPC belt" here) is uniformly charged with electricity to −800V by applying −800V with the power supply (not shown) to the contact type charging roller 2 so that the image bearing member rotates at a constant speed of 100 mm/sec.

As shown in FIG. 9B, image exposure is performed by the writing apparatus 3, and then a latent image which has n levels of electric potential difference is written on the image bearing member 1. At this time, 5 (n=5) levels of electric potential patterns are formed by the changing light intensity exposed according to the colors being developed. In this instance, according to the basic five colors, that is, black (hereinafter referred to as "Bk"), white (hereinafter referred to as "W"), yellow (hereinafter referred to as "Y"), magenta (hereinafter referred to as "M"), and cyan (hereinafter referred to as "C"), the light intensity was determined to be 0.74, 0.00, 0.15, 0.32, and 0.52 in relative value, respectively. As a result, the corresponding electric potential for each level was −317V (black latent image), −800V (non-image portion or White), −663V (yellow latent image), −536V (magenta latent image), and −417V (cyan latent image).

As shown in FIG. 9C, the reverse development process is performed for the black latent image with black toner Kt, which is charged with an average specific charge of q/m=−20 μC/g by applying a rectangular wave of −387V±80V to the electrostatic transporting roller 42 of the developing apparatus 4K. At this time, a temporal and spatial average potential difference Vb of electrodes 102 corresponding to the conventional development bias is −387V. Consequently, negative charged toners, which are made to hop between the OPC belt (image bearing member) 1 and the electrostatic transporting roller 42 are moved to an image portion (exposure) pixel by the electrostatic force generated by the electric field between the OPC belt (image bearing member) 1 and the electrostatic transporting roller 42 and adhere thereto.

Then, the electric potential of the black toner Kt, which adheres to the OPC (image bearing member 1), is −60V and the mass per unit area m/A is 0.5 mg/cm2. In other words, the electric potential of the developed part becomes −377V. The −377V is created by adding the toner electric potential −60V to the electric potential −317V after exposure. Then, the potential of the developed part (−377V) is higher than the potential difference (−317V) after exposure.

After developing black (K), as shown in FIG. 10A, a uniform exposure is performed by the uniformly exposing device 23A by illuminating at a wavelength of 650 nm and a relative intensity of 0.20 to the OPC belt 1. At this time, a portion developed with black toner Kt absorbs about 90% of the LED light, so the electric potential of that portion decreases a little from −377V to −360V. In this description, terms, such as "decrease", "increase", "high", and "low", are described in absolute value. If the amount of toner increases, then the decreasing electric potential during the uniform exposure of the portion developed with black toner also becomes less. However, an increase in the amount of toner does not ordinarily improve development because more developer toner does not contribute to more image density.

In contrast thereto, the electric potential of a portion not developed with black toner dramatically decreases because that portion receives almost 100% of the LED light. Consequently, the electric potential of the portion corresponding to W, Y, M, or C decrease, respectively, from −800 to −625V, from −663V to −492V, from −536V to −371V, and from −417V to −260V. In each of FIGS. 9-12, a dash line indicates the electric potential before exposure, and a solid line indicates the electric potential after exposure.

As shown in FIG. 10B, reverse development is performed with cyan toner ct by applying a rectangular wave of −330V±80V to the electrostatic transporting roller 42 of the developing apparatus 4C. In common with the case of black toner, the negative charged toner adheres to the cyan latent image whose electric potential −260V is 70V less than the electric bias −330V. The toner electric potential is also −60V and the electric potential of the portion where the cyan toner adheres becomes −320V after development.

As shown in FIG. 11A, a second uniform exposure is performed by illuminating light having a wavelength of 650 nm and a relative intensity of 0.23 to the OPC belt 1 using the uniformly exposing device 23B. At this time, a portion developed with black toner Kt and cyan toner ct absorbs about 90% of the LED light, so the electric potential of those portions do not decrease very much. The electric potential of a portion without toners; however, greatly decreases because that portion receives almost 100% of the LED light. In addition, 650 nm is chosen as the wavelength for exposure because the spectral transmission factor of cyan toner has the lowest value at 650 nm.

For example, as a result of the second uniform exposure, the electric potential of the portion with black toner Kt or cyan toner ct decrease from −360V to −342V, and from −320V to −302V, respectively. The electric potential of portions without toners corresponding to W, Y, and M decrease from −625V to −435V, from −492V to −311V, and from −371V to −201V, respectively.

As shown in FIG. 11B, reverse development is performed with magenta toner mt by applying a rectangular wave of −271V±80V to the electrostatic transporting roller 42 of the developing apparatus 4M. In common with the case of black toner, the negative charged toner adheres to the magenta latent image whose electric potential −201V is 70V less than the electric bias −271V. The toner electric potential is −60V, and the electric potential of the portion where the magenta toner adheres becomes −331V after development.

As shown in FIG. 12A, the third uniform exposure is performed by illuminating light at a wavelength of 583 nm and a relative intensity of 0.30 to the OPC belt 1 using the uniformly exposing device 23C. At 583 nm, the spectral transmission factor is the lowest value for both cyan toner ct and magenta toner.

As a result, in common with the first and second uniform exposure, the electric potential of a part developed with black toner Kt, cyan toner ct, and magenta toner mt does not decrease very much, and the electric potential of a portion without toners decreases greatly. For example, the electric potential of a portion with black toner Kt, cyan toner ct, and magenta toner mt decreases from −342V to −317V, from −271V to −217V, and from −302V to −256V, respectively. The potential for magenta and cyan toner is greater than the potential decrease for black toner because the transmitting factor of 583 nm is larger than the transmitting factor of 650 nm so the toners absorb only about 80% of the light. In contrast thereto, the electric potential of a portion without toners corresponding to W or Y decreases greatly from −435V to −218 V and from −311V to −118V, respectively.

As shown in FIG. 12B, reverse development is performed with yellow toner yt by applying a rectangular wave of −188V±80V to the electrostatic transporting roller 42 of the developing apparatus 4Y. In common with the case of black toner, the negative charged toner adheres to the yellow latent image whose electric potential −118V is 70V less than electric bias −188V. The above described operations complete formation of the full color toner image.

In this way, a full-color print can be formed by charging an image bearing member once, forming a latent image, developing the latent image four times, transferring the full-color toner image formed on the OPC belt 1 by applying a transfer potential difference −300V to the transferring roller 5, and fixing the image using fixing apparatus 6. An image formed in this way, although having a slightly decreased density, results in a pastel and bright color tone.

In this manner, an image forming apparatus for forming color image on an image bearing member using at least four kinds of color toner is operated to uniformly charge the image bearing member once, to form a latent image including n levels of electric potential on the image bearing member with one exposure, to adhere the first toner to a portion which has the lowest electric potential in absolute value by a reverse development method, to continuously decrease the electric potential of a portion not developed with the first toner in absolute value by a first uniform exposure at a wavelength whose transmission factor is low for the first toner, to develop a portion which has the lowest electric potential in absolute value with the second toner in a reverse development method, to perform a second uniform exposure at a wavelength whose transmission factor is low for both of the first toner and the second toner, to develop a portion which has the lowest electric potential in absolute value with the third toner in reverse development method, to perform a third uniform exposure at a wavelength whose transmission factor is low for all of the first toner, the second toner, and third toner, and to develop a portion which has the lowest electric potential in absolute value with the fourth toner in a reverse development method. Consequently, an image forming apparatus and method for forming a full-color or multi-color image using a novel one shot exposing process with an ordinary photoconductor is provided.

Further, by uniformly exposing with light where a transmission factor for the first toner is the highest, the present invention enables more certain multiple-step decreasing of the electric potential for portions of an image bearing member not developed. Further, if the first toner is black toner, a transmission factor of the first toner is the highest. In addition, the present invention enables forming full color images by a novel one shot exposing process where the four kinds of toner is a combination of black, cyan, magenta, and yellow for forming a full color image.

Next, the relationship between the mentioned construction and developing device is explained. As described above, in the case of a one shot exposure, developing with a desired color toner, decreasing an electric potential by uniformly exposing the image bearing member, and then developing with the next color toner, a development method for precise developing even with minor electric difference is preferable. As a development device for developing even with minor electric difference, the EH development is suitable. More specifically, in the EH development, toners are made to hop, and are transferred to close proximity to the latent image on the image bearing member by electrostatic transporting. At that point, there can be two kinds of electric fields corresponding to a portion of the latent image. That is, each toner is attracted to a portion of the image, or is repelled from that portion based on the electric field. Finally, development is performed. So the development sensitivity of EH development is higher than that of the conventional development method.

It is now explained in correlation the with the conventional bi-component development method why this EH development constitutes a high sensitivity development. In the bi-component development method (magnetic brush development), which is a representative example of a conventional development method, the development amount m/A per unit area of toner for the development potential difference is shown in FIG. 13. See for example, ("Electropthotography Principles and Optimization", author: Merlin Scharfe, translator: Fuji Xerox Research Institute, publisher: CORONA PUBLISHING CO., LTD.)

The image density required for normal printing is 1.4, and the toner mass m/A per unit area required to obtain the normal image density is 0.5 $mg/cm_2$. In other words, in conventional magnetic brush development, 300V is the required potential difference for development (i.e., the differential between the potential of the image and the development bias). This potential difference for development is required for separating carriers from toners and adhering the toners to the image portion of the OPC latent image. In fact, the same potential differential is required for separating toners which adhere to blank portions on the OPC and directing those toners to the magnetic brush. Hence, a combined potential difference of 600V is required.

Thus, in image forming devices such as a normal printer or a copier, development is performed by charging an image bearing member −700V, exposing the image beaming with light to make the potential difference of the image portion −100V, and applying −400V as a development bias, generally.

Therefore, within the scope of the conventional development method, if image formation was attempted in a one photoconductor/one rotation/one charge superimposing type process, then the charging device of the image bearing member is needed to be larger than −1800V. In this case, an electric field provided on the photoconductor is 3 times larger than the normal value, and consequently shortens the lifetime of the photoconductor dramatically. By tripling the thickness of the photoconductor, the electric field provided on the photoconductor maintains a normal level. However, in the case of a dual-layered OPC, which is a kind of conventional OPC that has a charge generation layer under a charge transport layer, positive holes generated by light transport diffuse broadly in the charge transport layer having thickness three times the normal value. Consequently, formed image are blurred which clearly is not acceptable for practical use.

As a practical matter, even in a jumping type of development which is a non-contact type development, practically the same potential difference as the foregoing value is necessary to separate toners from carriers and to separate toners that adhere to non-image portions in the reverse direction. In fact, some toners adhere to the non-image portion because the toners are reciprocating intensively between the carriers and the image bearing member despite the non-contact type of development.

In contrast, in the EH development, development sensitivity is high as shown in FIG. 14. FIG. 14 proves that the required development potential difference to get m/A=0.5 mg/cm2 per unit area is only 70V. In addition, because in the EH development toner does not contact with non-image portions, a strong electric field required to recover toners is unnecessary. All that is required is the moderate electric field for recovering hopping toners. For this purpose, in the above described embodiment 30V is described, but 10V is sufficient in practice. Even in the case of 10V, a problem of fogging does not arise.

Therefore, although in the above described embodiment the potential difference for the initial and sole charge is 320V, a charge of an even lower potential difference is able to form a proper image in practice.

In addition, although FIG. 14 shows a case where an average ratio charge q/m is −23 μC/g, as q/m decreases the required development potential difference to get m/A=0.5 mg/cm2 per unit area decrease pro rata. In view of this, it is also possible to form a proper image with a lower potential difference.

Furthermore, in the above described embodiment, a developing apparatus which develops using a conventional powder cloud development method can be used instead of a developing apparatus performing EH development method. In the case of powder cloud method, toner is relatively free and floats in the air the same as with EH development. However, in the conventional powder cloud method, scumming occurs more frequently because the motion of the toner is not controlled in the same manner as with EH development.

Further, the above mentioned image forming apparatus can be configured to form a potential difference latent image with electrostatic action instead of forming an image with a photoconductor. In this case, for example, the latent image can be written directly on dielectric material as an image bearing member by an electrostatic stylus using an electrostatic recording method. Although detailed explanation is omitted here, the operations performed after forming a potential difference latent image are the same as above described.

Further, the image forming apparatus described above for forming a full color image can be configured to form multicolor images using two, three, four, or more types of color toner.

Next, comparative data is described.

Comparative Data 1

The resulting image formation using an OPC whose photosensitive layer is 40 μm thick instead of an OPC whose photosensitive layer is 20 μm thick included color mixture in an isolated dot. For example, an isolated cyan pixel included a little magenta toner or yellow toner. One reason for this mixture is that the LED light illuminated a region around the isolated cyan toner pixel and then exposed a region located immediately below the isolated cyan toner pixel because the photosensitive layer is sufficiently thick. Another reason for the mixture is that the light carrier (electron hole) generated at the outer side of the region located immediately below the isolated cyan toner pixel diffused to the region located immediately below the isolated cyan toner pixel by moving through the charge transport generated by each other's Coulomb repulsion.

To prevent the above mentioned disadvantage, the thickness of the photosensitive layer is preferably made less than at least the size of one dot. Moreover, to prevent the problem completely, the light carrier generating region is preferably the surface of the photosensitive layer.

Comparative Data 2

The result of developing with yellow toner first, and then performing the first uniform exposure at a wavelength of 583 nm of LED light, was the yellow image had a slight color mixture. The reason for the slight color mixture was that yellow toner has less light blocking effect than black toner.

This problem can be resolved by reducing the electric potential of a portion corresponding to the yellow latent image during image exposure by a corresponding amount. However, in order not to expend electric potential wastefully, it is preferable to use toner which has the most light blocking effect first. In other words, as mentioned above, it is preferable to use black toner as the first toner.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming method for forming color images on an image bearing member utilizing a plurality of toner, comprising the steps of:

charging uniformly the image bearing member once, the image bearing member including only one photosensitive layer;

writing a latent image having a plurality of levels of electric potential on the image bearing member with a single exposure;

adhering a first toner on a first portion of the image bearing member having a lowest electric potential;

decreasing an electric potential of a portion of the image bearing member not developed with the first toner by uniformly exposing the image bearing member with light at a first wavelength whose transmission factor is lowest for the first toner;

adhering a second toner on a second portion of the image bearing member having a second lowest electric potential;

decreasing an electric potential of a portion of the image bearing member not developed with the first or second toners by uniformly exposing the image bearing member with light at a second wavelength whose transmission factor is lowest for each of the first toner and the second toner;

adhering a third toner on a third portion of the image bearing member having a third lowest electric potential;

decreasing an electric potential of a portion of the image bearing member not developed with the first, second, or third toners by uniformly exposing the image bearing member with light at a third wavelength whose transmission factor is lowest for each of the first toner, the second toner, and the third toner;

adhering a fourth toner on a fourth portion of the image bearing member having a fourth lowest electric potential.

2. The image forming method of claim 1, wherein a transmission factor of the first toner is the highest transmission factor of the toners.

3. The image forming method of claim 1, wherein the first toner is black toner.

4. The image forming method of claim 1, wherein a thickness of the photosensitive layer of the image bearing member is less than a size of one dot, wherein the size of one dot is 28 micrometers for a printing density of 1200 dpi, and the size of one dot is 42 micrometers for a printing density of 600 dpi.

5. The image forming method of claim 1, wherein the image bearing member includes a light carrier generating region on the surface of a photosensitive layer.

6. The image forming method of claim 1, wherein the toners include black, cyan, magenta, and yellow, for forming a full color image.

7. The method of claim 1, wherein the first, second, and third wavelengths are not all a same wavelength.

* * * * *